United States Patent [19]

Brown et al.

[11] 4,200,411

[45] Apr. 29, 1980

[54] SUBMERGED OFFSHORE STORAGE FACILITY

[75] Inventors: George R. Brown, Lagos, Nigeria; Joseph C. Carroll, Abqaiq, Saudi Arabia; Sidney E. Dubuisson, Kokkedal, Denmark

[73] Assignee: Texaco Inc., White Plains, N.Y.

[21] Appl. No.: 925,133

[22] Filed: Jul. 17, 1978

[51] Int. Cl.[2] ..... B65G 5/00; E02D 27/38; E02D 29/00

[52] U.S. Cl. ..... 405/210; 114/257; 220/428

[58] Field of Search ..... 405/210; 114/257; 141/388, 387, 279; 137/236; 220/9 A, 13; 210/170, 83, 84

[56] References Cited

U.S. PATENT DOCUMENTS 3,858,402 1/1975 Baker et al. ..... 405/210

FOREIGN PATENT DOCUMENTS 47-6946 8/1972 Japan ..... 405/210

*Primary Examiner*—Alexander Grosz

*Attorney, Agent, or Firm*—Thomas H. Whaley; Carl G. Ries; Robert B. Burns

[57] ABSTRACT

Underwater liquid storage tank or facility adapted to hold or temporarily store varying quantities of a liquid having a density less than water. Said liquid can include crude oil and petroleum products. The facility includes means for maintaining the holding space in a full condition by the addition or removal of water. Further included is means to avoid inadvertent pollution of the surrounding water through the unintentional discharge of amounts of the less dense liquid which can be carried by water leaving the tank. Also included is means forming a protective barrier about the liquid holding tank to avoid serious leakage and possible damage to the environment in the event the facility is ruptured by a floating vessel or other object.

4 Claims, 2 Drawing Figures

FIG. 1
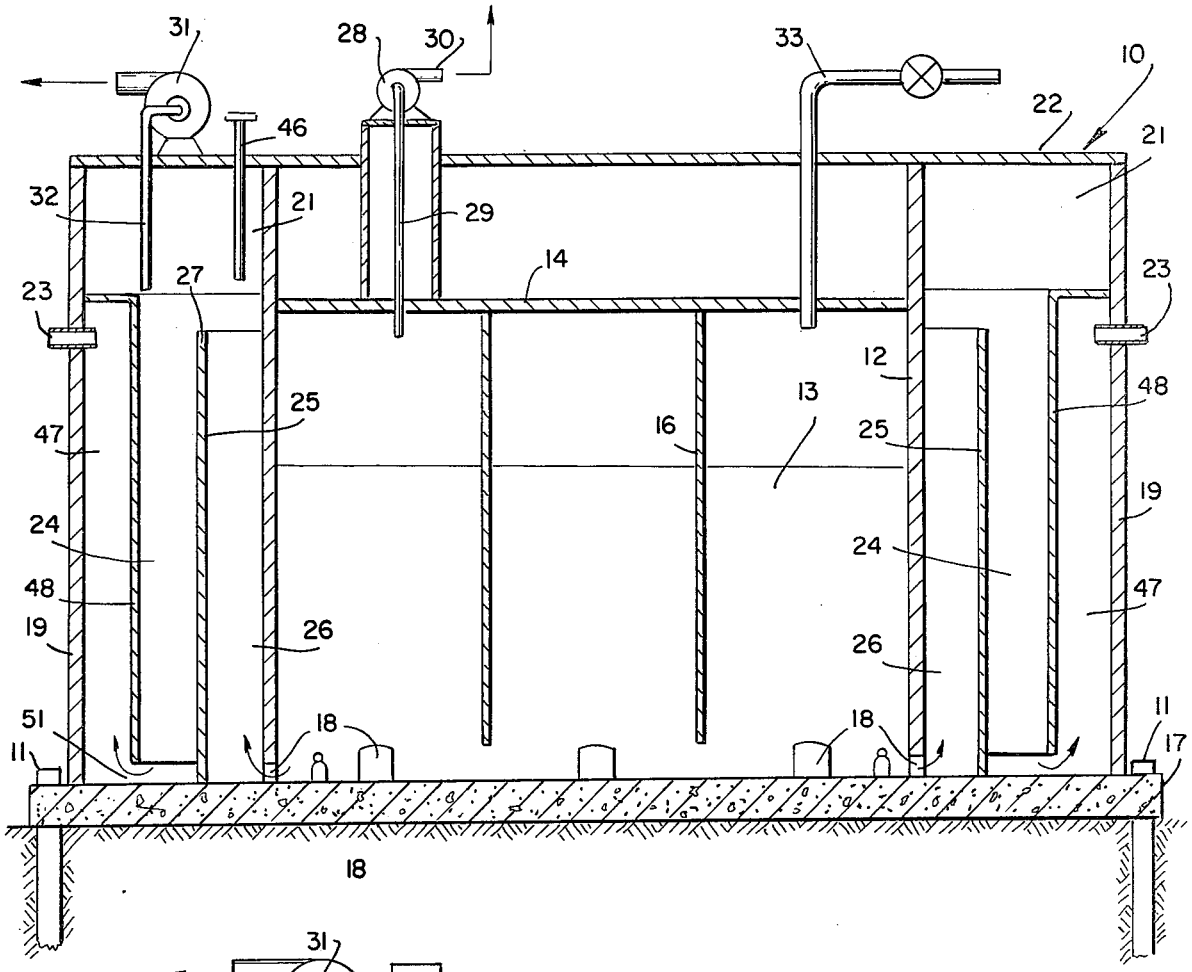
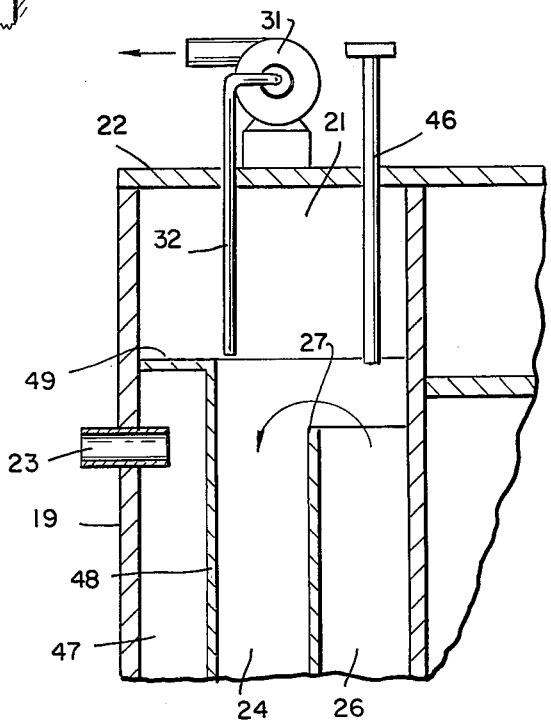
FIG. 2

SUBMERGED OFFSHORE STORAGE FACILITY

BACKGROUND OF THE INVENTION

In the offshore storage of liquids characterized by a density less than that of water, such as petroleum products, crude oil and the like it is both desirable and economical in many respects to store the liquids beneath the water's surface. Such storage, has the concurrent drawback, however, that there is a strong possibility of leakage of the petroleum products. Such leakage could permit passage of the lighter components to the water's surface and thereby possibly create a polluting condition.

As a practical expedient such holding of petroleum products prior to their being transferred to a vessel or piped to a shore installation, the underwater tank or storage facility is normally ballasted with the surrounding water as the lighter products are withdrawn. Further, as the lighter products are introduced to the tank, the ballast water is displaced from the main storage facility and normally discharged into the surrounding water.

The system as a whole is found to work effectively in maintaining the storage facility always in a full condition and wholly ballasted. However, at least one primary fault in the system persists. Thus, water which is discharged from the storage zone by incoming hydrocarbon liquid, tends to carry residual liquid along with it as the water is urged from the tank. This residual oil or other lighter than water product will gravitate toward the water's surface where it could create a visible sheen or other discoloration and possibly a water polluting condition.

A number of ways have been suggested toward making this type of facility both practical and environmentally acceptable, by treatment of the water which is discharged from the storage tank to cause separation from the oil. Many of the systems presently known utilize some form of separator or skimmer arrangement which operates during the transfer operation to treat discharge water. After treatment, the water can usually be returned safely to the surrounding area.

Such treatment normally requires that the body of water to be treated possess a degree of quiescence rather than being in a turbulent or disturbed state. In the latter state there would be a tendency to mix the two liquids rather than permit the lighter component to float to the surface of the heavier component.

Toward providing a suitable means for effecting a separation of oil from displaced water, the present invention provides an underwater tank of the type suggested. Discharged ballast water is received in a relatively expansive settling area adjacent the storage tank such that it does have an adequate chance to reach a quiet state prior to being skimmed, separated, or in other ways removed from the supporting body of water.

A further advantage of this type of storage facility is overcome in that the storage means is provided with an insulating or buffer compartment. The latter contains water, first contacted, and will absorb the initial impact in an instance when the storage facility is inadvertently contacted by a moving vessel or other body. Thus, should such damage occur to the tank there will be no discharge of oil into the surrounding water; rather the jacketing tank will cushion external contact and serve to preserve the integrity of the inner member.

The instant invention is thus addressed to an underwater storage facility for concurrently holding varying quantities of water and petroleum products. While many products can be so stored, for the present description the terminology oil will be referred to as the stored product, which term further covers a host of hydrocarbon liquids. The latter, in any event, being lighter than water, will tend to rise to the surface of the water under all circumstances.

Physically the disclosed facility thus includes a central holding tank or compartment defined by liquid tight walls and a roof enclosure. The latter two in effect concurrently contain the two liquids in varying amounts as required, with a varying interface therebetween. Pumping means communicated with the holding or storage compartment regulate the amount or flow of oil which is transferred to or from the facility. A collecting tank is positioned to receive residual oil rather than permitting the latter to be discharged to the surrounding water.

One object of the invention therefore is to provide a subsea storage facility for concurrently holding both water and oil, said facility being equipped to foster separation of the two liquids. Another object is to provide a weir section communicated with the tank storage area whereby to promote further separation of oil from the water. A still further object of the invention is to provide a collector means communicated with the main storage facility whereby the lighter component liquid will tend to float to the surface and be withdrawn from the collecting area. Still another object is to provide a jacket about the liquid holding facility which will function to protect the latter in the event it is damaged by contact with a floating vessel or other object.

DESCRIPTION OF THE DRAWINGS

FIG. 1 is an elevation view in cross-section of the storage facility.

FIG. 2 is a segmentary view on an enlarged scale and in cross-section of a segment of the facility shown in FIG. 1.

In one embodiment of the invention, the liquid storage facility 10 is illustrated at a fixed position at the floor of a body of water. Normally the unit is firmly secured in place so that only the upper surface is exposed. Thus, fastening means such as piles 11 or similar devices, are used to anchor it to the ocean floor.

As shown, the unit's upper end projects slightly above the water's surface. However, it can be more fully submerged beneath the water as will be hereinafter noted and still function as required. In either instance, necessary piping, pumps, and other hardware can be supported on the facility itself. Alternately such equipment can be raised above the water's surface by a supporting superstructure.

Referring again to FIG. 1, the facility comprises in essence a continuous upstanding inner wall 12 which is preferably circularly shaped as to form an interior storage area 13. A roof or upper panel 14 connected to said wall 12, defines the storage or holding compartment 13 therebeneath.

Said roof 14 can be contoured or otherwise shaped to achieve a maximum degree of structural strength. However, depending on the material of which the roof is made, including steel, concrete or the like, it is structured to form a water tight closure for confining both water and oil. A plurality of baffle members 16 can be disposed within the tank storage area 13 at appropriate spacing to minimize the degree of movement of water and oil contained therein.

The lower end of the storage tank is supported at the ocean floor. Said lower end can include a heavy footing or foundation 17, or it can be an integral part of the tank itself. In the latter instance foundation 17 is connected to the upstanding wall 12 during the manufacturing stage and prior to the unit being floated to a working site.

The storage tank inner wall 12 is provided with a plurality of openings 18 at the lower end to permit free passage of water between storage area 13 and the outwardly adjacent compartment. Said openings can be further utilized for removing sludge and other solids which settle to the tank floor.

An upstanding outer wall 19 is disposed adjacent to but spaced from inner wall 12. Said outer wall 19 comprises a continuous, fluid tight member formed to define a collecting chamber 21 therebetween. Chamber 21 is provided with an upper closure panel 22 which is fastened between walls 12 and 19. The panel thus defines a torus-like collecting area 21 into which lighter fluids will tend to rise and be accumulated as water is passed from storage tank 13.

Outer wall 19 is provided with one or more openings or ports 23 near the upper end thereof at a level beneath the water's surface. Ports 23 thus communicate collecting chamber 21 with the water into which the storage facility is submerged.

An upstanding intermediate panel 25 is disposed within the lower end of collecting chamber 21, extending upwardly therethrough and terminating at a point below the top of said chamber. Said intermediate panel 25 serves to divide the lower end of collecting chamber 21 into inner and outer upstanding compartments 24 and 26 respectively, which are communicated at the upper edge of the panel.

Panel 25 upper edge 27 defines, and functions as a first weir across which the flow of liquid will pass during either an incoming or discharge stage. Thus, as water is forced across weir 27 the lighter oil component will tend to separate from the moving water stream and rise into the upper end of the collecting chamber 21.

To effect a transfer of confined liquid from the storage area 13 to an external facility, an inlet conduit 33, as well as pumping means 28 are provided. Said pumping means 28, as herein noted, can be positioned atop the storage tank or elevated on a superstructure. Pumping means 28 includes an elongated inlet conduit 29 which extends downwardly through roof member 14 to which it is sealably attached, and opens at its lower end into storage area 13. The discharge 30 of pump 28 can communicate with a shore facility through an appropriate pipeline. However, it can also merely function to temporarily connect the storage area 13 to an adjacently moored tanker or similar floating transport vessel.

Collecting chamber 21 is disposed, as noted, to receive oil which separates from and rises through the passing water stream. Said collecting chamber 21 is provided with a second pumping means 31 having the extended intake pipe 32 thereof terminating at the upper end of the collecting chamber. Thus, the surface layer of oil lying on water accumulated in said chamber 21 can be removed when pump 31 is actuated. The removed product, usually an emulsion of oil and water, is then directed to a suitable settling pond or collecting area where it can be skimmed or otherwise treated to separate the two components.

To permit automatic operation of the separating process, collecting chamber 21 is provided with a level sensor or probe 46. Functionally, the latter extends normally or fixedly into chamber 21. The probe includes a sensor member at the lower end which contacts liquids. Thus, at such time as the oil layer thickens, or is detected, the probe will sense such charge and activate pump 31 to commence an oil and water removal operation. Conversely, when the oil level is depressed, or absent, pump 31 will be stopped whereby to discontinue further water removal.

The tank storage space 13 is protected from possible damage by a jacket or peripheral barrier 47. The latter further functions as a segment of the normal passage for water flow into and out of the storage space.

Said barrier is composed of an upstanding wall 48 which is fixedly spaced inwardly of outer wall 19.

A cover section 49 extends between the respective walls 19 and 48, providing a sealed closure. Thus, water which enters interspace 47 by way of port 23, will be guided downwardly through the barrier section to the lower end thereof. The flow can then continue upwardly, by way of passage 51 into compartment 24.

During water discharge period, the flow will be reversed, to flow downwardly through compartment 24 and up through 47. In summary, compartment 47 will always hold a supply of water whether in a quiescent state, or flowing.

Should the outer wall 19 of the unit be struck by a heavy body such as a ship's hull, or the like, and wall 19 is fractured, only water will be discharged to the surrounding area. Further, due to the elasticity of said wall 19, it will be deformed inwardly such that the confined water will absorb much if not all of the impact energy.

In addition, the compressing of water in the barrier chamber 47 will tend to force the water from port 23 as well as by a rising of the water level in collecting chamber 21.

Other modifications and variations of the invention as hereinbefore set forth can be made without departing from the spirit and scope thereof, and therefore, only such limitations should be imposed as are indicated in the appended claims.

We claim:

1. A liquid storage facility for an underwater site to hold varying quantities of water, as well as a liquid having a density less than that of water, by maintaining the tank in a full condition under all operating circumstances, which facility includes;

a continuous inner wall (12) having an upper closure (14) which defines a central storage tank for concurrently holding amounts of said respective liquids, conduit means (29 and 33) communicated with said central storage tank for controllably regulating the amount of liquid held therein, means forming a collecting chamber communicated with the lower end of said storage tank and being segregated from the surrounding water, panel means (27) disposed within said collecting chamber forming the latter into upright compartments (24 and 26) which are in communication at the panel (27) upper edge, withdrawal means (31 and 32) in said collecting chamber being operable to withdraw liquid therefrom, and sensing means in said collecting chamber which is sensitive to the presence of said less dense liquid within said collecting chamber, and which is integral with said withdrawal means (31 and 32) for activating the latter in response to the presence of said lighter liquid.

2. In an apparatus as defined in claim 1, wherein said means forming said collecting chamber includes; upstanding wall 48 defining a settling pool with enclosure and an overflow passage means communicating said settling pool enclosure with said collecting chamber.

3. In an apparatus as defined in claim 1, including; means forming a weir 27 in said overflow passage communicating said collecting chamber with said settling pool.

4. In an apparatus as defined in claim 1, including; a closure 22 extending across said settling pool enclosure to segregate the latter from the surrounding water.

* * * * *